United States Patent [19]

Irie et al.

[11] 4,101,214

[45] Jul. 18, 1978

[54] TONER DISPENSING DEVICE WITH ELECTRICAL INTEGRATING CIRCUIT

[75] Inventors: Yutaka Irie; Tomoji Murata, both of Toyokawa; Kenji Shibazaki, Aichi; Shigemitu Shimizu, Toyokawa; Yukio Tokura, Toyohashi; Shunji Yamamoto, Shinshiro, all of Japan

[73] Assignee: Minolta Camera Kabushiki Kaisha, Osaka, Japan

[21] Appl. No.: 645,914

[22] Filed: Dec. 31, 1975

[30] Foreign Application Priority Data

Jan. 13, 1975 [JP] Japan ..... 50-7419[U]

[51] Int. Cl.[2] ..... G03G 15/10

[52] U.S. Cl. ..... 355/10; 118/646; 355/14

[58] Field of Search ..... 355/10, 3 DD, 13, 14; 118/637, DIG. 23, 7, 8, 646; 427/14

[56] References Cited

U.S. PATENT DOCUMENTS

| | | | |
|---|---|---|---|
| 3,094,049 | 6/1963 | Snelling | 95/89 |
| 3,334,566 | 8/1967 | Friedel | 95/89 |
| 3,354,802 | 11/1967 | Doucette et al. | 95/89 |
| 3,376,853 | 4/1968 | Weiler et al. | 118/637 |
| 3,376,854 | 4/1968 | Kamola | 118/637 |
| 3,409,901 | 11/1968 | Dost et al. | 118/646 X |
| 3,472,143 | 10/1969 | Hixon et al. | 95/89 |
| 3,504,968 | 4/1970 | Matkovich et al. | 355/10 |
| 3,514,203 | 5/1970 | Zerfahs | 95/89 |
| 3,527,651 | 9/1970 | Shelffo et al. | 118/7 X |
| 3,532,047 | 10/1970 | Pensgen | 95/89 |
| 3,587,521 | 6/1971 | Rubenstein | 118/7 |
| 3,635,555 | 1/1972 | Kurahashi et al. | 355/10 X |
| 3,693,581 | 9/1972 | Quant | 118/7 |
| 3,719,165 | 3/1973 | Trachienberg et al. | 118/7 |
| 3,779,204 | 12/1973 | Altmann | 118/8 |
| 3,821,938 | 7/1974 | Bacon et al. | 118/7 |
| 3,872,825 | 3/1975 | Davidson | 355/3 DD |
| 3,876,116 | 4/1975 | Kushima et al. | 118/7 X |
| 3,892,672 | 7/1975 | Gawron | 355/3 DD |
| 3,897,748 | 8/1975 | Hirata et al. | 118/7 |
| 3,932,034 | 1/1976 | Takahashi | 355/3 DD |
| 3,941,084 | 3/1976 | Kurita | 118/7 |

*Primary Examiner*—R. L. Moses

*Attorney, Agent, or Firm*—Wenderoth, Lind & Ponack

[57] ABSTRACT

An electrophotographic copying apparatus incorporating therein an improved developing material supplying device which supplying device includes a copy paper detecting unit for detecting the length of the copy paper, an integrating circuit for integrating the length of the copy paper detected by the detecting unit and a supply tank driving unit which operates the supply tank to supply a concentrated developing material into the developing tank through a valve, upon receipt of a signal from the integrating circuit, by which arrangement, the concentrated developing material can be supplied to the developing tank every time after a predetermined length of the copy paper is fed through the developing tank.

12 Claims, 5 Drawing Figures

TONER DISPENSING DEVICE WITH ELECTRICAL INTEGRATING CIRCUIT

The present invention relates to an electrophotographic copying apparatus and more particularly, to a developing device provided with a developing material or toner dispensing means for use in an electrophotographic copying apparatus.

Generally, in the copying apparatus of the above described type, a developing material, such as toner in the form of powder or liquid for the transfer of the visualized image onto a copy material or a copy paper sheet, had to be supplied by a suitable toner supplying means to maintain a predetermined density of toner in the developing station.

In keeping the developing material in optimum condition, the best way is to detect directly the density of the developing material in the developing station and to supply the developing material thereto, in accordance with the consumed amount of the developing material. However, in such a method, it is not only difficult to arrange such a system, but also a complicated and expensive mechanism which will not balance with the manufacturing cost is required.

In conventional copying apparatus, the amount of consumed developing material is detected by the number of sheets having passed through the developing station, and from which number as estimated amount of developing material consumed in copying operation is supplied to the developing station to maintain a certain density level of the developing material contained therein. However, with such estimate, the difference in the size of copy papers are not taken into consideration thereby causing an erroneous differnce between the amount obtained from the estimation and the amount actually consumed, which will result in a disadvantage such as over or under supply of the developing material and further in high or low contrast in the image on the copy paper.

Therefore, a main object of the present invention is to provide an electrophotographic copying apparatus equipped with an improved type of developing material dispensing device which device will supply a more accurate amount, than conventional type, of developing material in relation to the amount of consumed developing material so as to keep a predetermined density of the developing material in the developing station.

Another object of the present invention is to detect the length of the copy paper provided toward the developing station.

A further object of the present invention is to integrate the length of the copy paper detected, and to produce a signal after having integrated a predetermined length of the copy paper passing through the developing station.

As still further object of the present invention is to provide a developing material dispensing device which is suitable for supplying the developing material to the developing station upon receipt of the signal corresponding to the length of the copy paper.

According to the present invention, the amount of developing material consumed in the developing device is approximately determined by the amount of length of the copy paper conveyed through the developing station, while developing material equivalent to the consumed amount is periodically provided to the developing device from a supplying station to keep the developing material in optimum condition, which method can detect more precisely the amount of developing material consumed in the developing tank than by counting the numbers of the copy paper fed through the copying apparatus.

According to the copying apparatus of the present invention, a concentrated developing material is supplied to the developing station after each predetermined area of the copy paper has been fed through the copying apparatus. In other words, the developing material or the toner in the developing station is supplied with a concentrated developing material every time after a predetermined area of the copy paper has developed into a visualized image thereon.

In order to detect the area of the copy paper fed therethrough, the length and the width thereof need to be determined. Since the width of the copy paper is nomally constant, it is necessary to detect only the length of the fed copy paper.

The copying apparatus of the present invention is provided with a detecting means for detecting the length of the copy paper, a circuit means for integrating the length of the copy paper detected by the detecting means and for generating a signal after having integrated a predetermined amount, which amount substantially corresponds to the area of the copy paper, and a developing material supplying member together with a driving unit which actuates the supplying means between the developing material supplying member and the developing station, upon receipt of the signal obtained from the circuit means. dr These and other objects and features of the present invention will become apparent from the following description taken in conjunction with the preferred embodiment thereof with reference to the accompanying drawings, in which;

Before the description of the present invention proceeds, it is to be noted that like elements are designated by like reference numerals throughout several views of the attached drawing.

Figure 1:
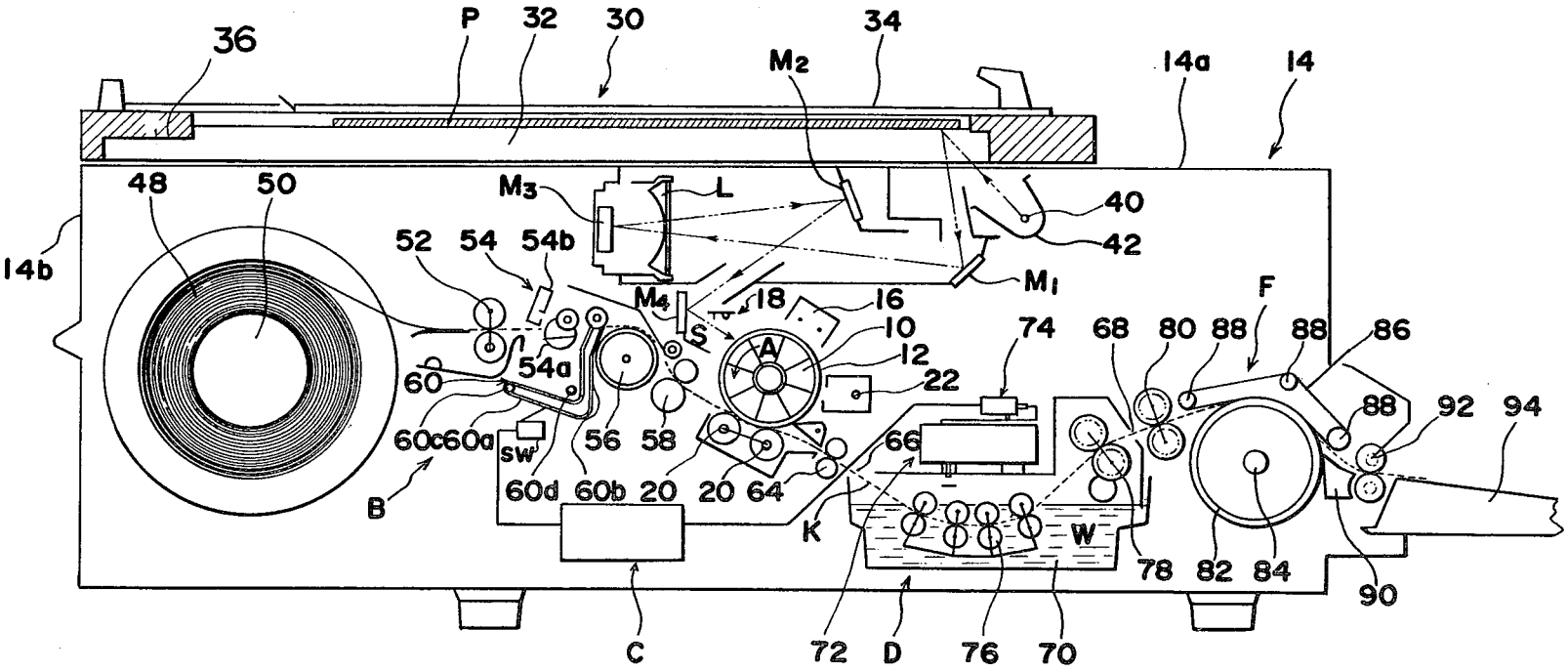
FIG. 1 is a schematic diagram showing a sectional side view of a copying apparatus according to the present invention.

Referring to FIG. 1 the electrophotographic copying apparatus of the present invention generally comprises a drum 10 having a photoreceptor surface 12 on the outer periphery thereof and rotatably mounted on a shaft journaled in the frame of the apparatus housing 14 to rotate in the direction indicated by an arrow A to cause the photoreceptor surface 12 to sequentially pass various processing stations disposed therearound, such as a charging station with a corona charger 16, a slit exposure station associated with a slit exposure device 18, a transfer station having transfer rolls 20 and a erasing station associated with a corona discharger 22. The electrophotographic copying apparatus further comprises horizontally movable platform 30 including transparent platen 32 and a frame 36 thereof, which is provided above the drum 10 and reciprocatingly supported at the upper surface 14*a* of the housing 14 to move in a left and rightward direction between predetermined distance by a suitable drive means (not shown). An original P to be copied is placed upon the platen 32 facing its surface downwardly, and is covered by a platen cover 34 pivotally secured on the frame 36 so as to intercept the external light directed thereto. Beneath the platform 30 and above the drum 10, an optical system arrangement including light source 40, for example, a halogen lamp or fluoresent lamp having a reflecting shade 42 for illuminating the original to be copied, is fixedly provided in the housing 14. An image light which corresponds to a pattern of the original P is reflected from the surface of the original P and is directed toward the photoreceptor surface via suitably inclined mirrors M1, M2, M3, and M4, and through an optical lens means L and a slit S formed by the slit exposure device 18.

The image light projected onto the photoreceptor surface 12 is transformed into electrostatic latent image, the pattern of which is in relation to that of the original P. The platform 30 is horizontally moved at such a speed as to synchronize with the rotation of the drum 10, so that the continuous image light reflected from the original P is sequentially projected on the photoreceptor surface 12, causing the consecutively obtained electrostatic latent image thereon to be in correspondence with entire pattern of the original.

Still referring to FIG. 1, the electrophotographic copying apparatus further comprises a roll 50 rotatably provided in the housing 14 adjacent to a right side wall 14*b* thereof, and a roll of copy material or copy paper 48 which is fixedly mounted on the rotatable roll 50 so as to feed the copy paper by rotation of the roll 50.

It should be noted that in feeding the copy paper, the roll of the copy paper 48 may rotate around the roll 50 instead of rotating the roll 50, in which case the roll 50 may be rigidly provided in the housing 14.

On the right side of, and adjacent to the roll of the copy paper 48, a pair of take-up rolls 52 are rotatably provided for feeding the web of copy paper from the roll of the copy paper 48 toward the transfer station, substantially between the transfer rolls 20 and photoreceptor surface 12 via a pair of cutter 54, a loop roll 56 and a pair of guide rolls 58, which are provided in the housing 14. At least one of the pair of the take-up rolls 52 is driven by a suitable driving means (not shown) coupled to a shaft thereof (not shown) through a clutch means (not shown) operated, for example, by a solenoid means (not shown) for selectively rotating and stopping the rolls 52, correspondingly to the period when the paper is taken out from the roll 50. The pair of cutter 54 comprises a rotatory blade member 54*a* and a stationary sheath member 54*b* which normally are separated from each other. When a predetermined length of the copy paper passes between the blade member 54*a* and the sheath member 54*b*, the rotatory blade member 54*a* is turned toward the stationary member 54*b* to insert a blade (not shown) into a sheath (not shown), thereby cutting the copy paper, and then, a cut sheet of copy paper is further fed toward transfer station by the guide rolls 58. In the meantime, the blade member 54*a* is turned back in its normal place, as shown in FIG. 1. The sheet of the copy paper is transported through the copying apparatus along a path K as described in a dotted line in FIG. 1.

The sheet of copy paper which has passed through the transfer station after having the latent image formed on the surface thereof, is further transported, via a pair of second guide rolls 64, toward a developing device D of wet developing type, mainly comprising a developing tank 70 containing a working solution *w* of toner in liquid state and arranged on the bottom of the housing 14, a solution supplying tank 72 positioned above the developing tank 70, driving unit 74 fixedly provided on the frame (not shown) in a position above the solution supplying tank 72, and four pairs of rotatable electrode rolls 76 provided in the developing tank 70. The copy paper sheet enters the developing tank 70 through a first aperture 66 and leaves therefrom through a second aperture 68 formed at left and right side of the developing tank 70, respectively. In the developing tank 70 at the right side thereof but above the surface of the working solution *w*, a pair of squeeze rolls 78 are rotatably provided on the wall of the developing tank 70 for squeezing out the working solution from the copy paper sheet which has passed through the electrode rolls 76 and then is taken out from the working solution *w*, wherein the latent image on the copy paper sheet is developed into visible image. The detailed description on the operation of the solution supply tank 72 together with a control member is described in detail later.

The copy paper sheet coming out from the developing device D, through a pair of absorbent rolls 80 positioned adjacent to the second aperture 68 for absorbing the remaining working solution, is fed into a fusing device F, comprising a fusing drum 82 having a fusing heater 84 in the central portion thereof for heating a surface of the fusing drum 82 and a fusing belt 86 movably supported by supporting rolls 88, while one portion of the belt 86 is extended along the surface of the fusing drum 82. The wet copy paper sheet is inserted between the fusing drum 82 surface and the fusing belt 86 for being dried and for fixing the visible image thereon, after which the copy paper sheet is peeled off from the fusing drum 82 surface by a separation claw 90 provided adjacent to the fusing drum with its edge contacting the fusing drum surface, then extruded out from the copying apparatus on a copy tray 94 through discharging roll 92 provided between the separation claw 90 and the copy tray 94.

During copying operation, the weakened developing solution can be thickened by supplying concentrated working solution from the solution supplying tank 72, so as to maintain the working solution *w* in the tank 70 in optimum density. The supplying operation of the concentrated working solution is controlled by the substantial length of the copy paper provided into and passed through the developing tank 70, i.e., the length of the copy paper used for copying, in such a manner that, a predetermined amount of the concentrated working solution is provided into the tank 70 every time after a predetermined length of the copy paper passes through the developing tank 70.

Still referring to FIG. 1, the length of the copy paper derived out from the paper roll 50 is detected by a detecting means B which produces an output signal only when the copy paper is taken out from the paper roll 50. The output signal from the detecting means B is provided to a circuit means C which integrates time correspondingly with the length of the derived copy paper, and generates a pulse signal after integrating certain period of time, toward the driving unit 74 to actuate a valve unit 140 connected between the solution supplying tank 72 and developing tank 70, which are most clearly seen in FIG. 2.

Referring back to FIG. 1, the detecting means B disposed adjacent to the cutter 54 comprises a V-shaped copy paper detecting acutator or paper sensing arm 60 having a base portion 60*a* extending along the path of copy paper, and also having a detecting projection 60*b* integrally extending upwardly at approximately right angles from right end of the base portion 60*a*. The left end of the base portion 60*a* is rotatably supported on the frame (not shown) by a pin 60*c*. The paper sensing arm 60 is urged to rotate counterclockwise around the pin 60*c* by a suitable spring means (not shown) and is engaged in normal position as shown in FIG. 1, by an engaging pin 60*d*, whereby the upper portion of the detecting projection 60*b* is positioned normally between the cutter 54 and the loop drum 56.

A paper detection switch *sw* is provided closely beneath the base portion 60*a* so as to respond with the movement of the paper sensing arm 60 in a manner as described hereinbelow.

Upon depressing of the detecting portion 60*b* by the leading edge of the copy paper web, the paper sensing arm 60 is forced to rotate in clockwise direction around the pin 60*c* for turning on the switch *sw*. During the passage of the copy paper therethrough, the paper sensing arm 60 remains depressed until the trailing edge of the copy paper cut to the predetermined length by the cutter 54 has passed therethrough, in which moment the paper sensing arm 60 is turned counterclockwise about the pin 60*c* to return to the normal position for turning off the switch *sw*.

It should be noted here that the paper detection switch *sw* for the detecting means B described as disposed adjacent to the paper sensing arm 60 and associated with the movement of the sensing arm 60 for detecting length of the copy paper passing through the path means in the embodiment of FIG. 1 may be disposed adjacent to the earlier mentioned clutch means (not shown) for the take-up rolls 52, for example, in such a position as to be associated with the movement of a plunger (not shown) of the earlier mentioned solenoid means (not shown) for clutch means, so that the length of the copy paper having passed through the path means can be detected in the similar manner to that in the detecting means B of FIG. 1.

Figure 2:
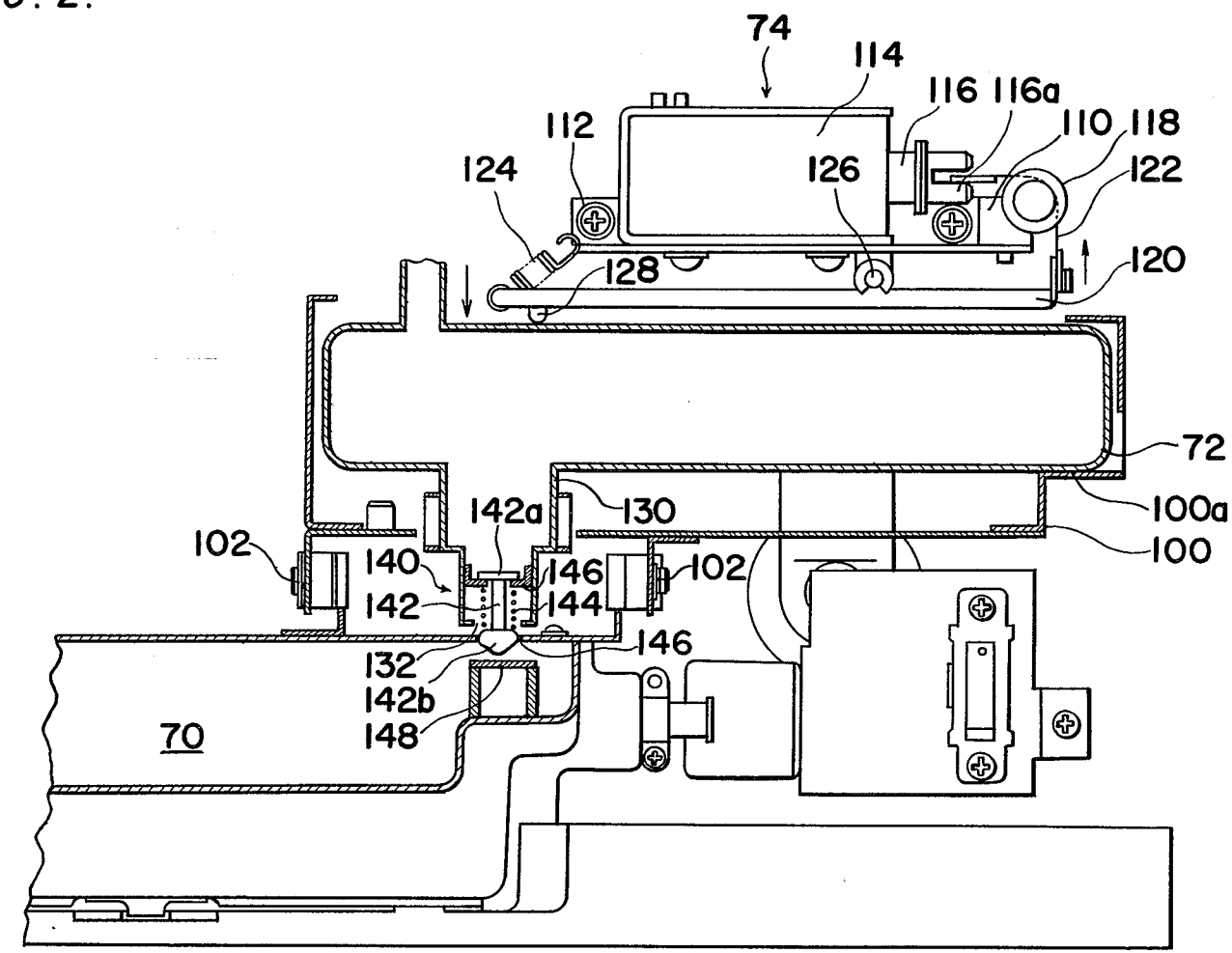
FIG. 2 is a schematic diagram showing a sectional side view, on an enlarged scale, of a developing device employed in the copying apparatus of FIG. 1.

Referring now to FIG. 2, the solution supply tank 72 is placed in a tank frame 100 which is fixedly provided on the developing tank 70 at upper portion thereof by a suitable securing screw 102. Normally, the solution tank 72 is horizontally positioned in such a manner that the right side bottom corner of the solution tank 72 is seated on a concaved portion 100*a* of the tank frame 100, so as not to rotate in clockwise direction. The left side of the solution supply tank 72 is freed from any hinderance so as to perform a downward movement within a perdetermined distance.

Positioned above and adjacent to the supply tank 72 is the driving unit 74 which comprises a supporting plate 110 fixedly supported on the housing 14 by a securing screw 112, a solenoid 114 being rigidly supported on the supporting plate 110 and having a reciprocally movable plunger 116 inserted therein with the head portion 116*a* extending rightwardly, a sheave 118 rotatably arranged at right end portion of the supporting plate 110, and a tilting plate 120 normally extending horizontally in the space between the driving unit 74 and the upper surface of the supply tank 72.

A right end portion of the tilting plate 120 is supported by a wire 122 which is directed to and fixedly held at the head portion 116*a* of the plunger 116 around the sheave 118, while a left end portion of the tilting plate 120 is supported by a spring means 124 which is hooked at left end portion of the supporting plate 110 urging the tilting plate 120 upwardly. The tilting plate 120 is further supported at middle portion thereof by a fulcrum 126 fixedly provided on a supporting plate 110 extruding downwardly. Therefore, the insertion of the plunger 116 into the solenoid 114 results in an upward movement of the right end portion of the tilting plate 120 and a downward mevement of the left end portion of the tilting plate 120. A projecting member 128 is provided on the tilting plate 120 on the under surface at left end portion thereof, projecting downwardly and contacting the upper surface of the solution supply tank 72 so as to depress the solution supply tank 72 downwardly and to rotate the same in counterclockwise direction in correspondence with the downward movement of the left end portion of the tilting plate 120.

Still referring to FIG. 2, the solution supply tank 72 has a projecting portion 130, at left side bottom portion thereof, extending downwardly toward the developing tank 70. The tip of the projecting portion 130 is coupled with a developing tank 70 by the valve unit 140 which comprises a displacable valve member 142 having a frange portion 142*a*, at upper portion thereof, being supported on an annular plate 146 which is fixedly provided in the projecting portion 130 and also having a valve head 142*b* at the lower end portion thereof extending outwardly from the projecting portion 130 through an orifice 132 and a spring means 144 arranged in between the annular plate 146 and the valve head 142*b* thereby urging the valve member 142 downwardly. Normally, the flange portion 142*a* tightly contacts the annular plate 146 to keep the concentrated working solution stored in the solution supplying tank 72. The valve head 142*b* is partly intruded into the developing tank 70 through an opening 146. A step 148 is provided in the developing tank 70 at a position below the valve member 142, normally, the tip of the valve member 142, i.e., the tip of the valve head 142*b* being positioned apart from the surface of the step 148.

Still referring to FIG. 2, the concentrated working solution in solution supplying tank 72 can be supplied into the developing tank 70 in such a manner as described hereinbelow.

The left portion of the solution supplying tank 72 is inclined downwardly by the depressing of the tilting plate 120 caused by the insertion of the plunger 116 being inserted into the solenoid 144 when energized, while the solution supplying tank 72 being inclined downwardly together with the valve unit 140, the tip of the valve head 142*b* contacts the surface of the step 148, and the valve member 142 can be further inserted into the projecting portion 130 against the spring means 144, so as to open the valve unit 140, substantially by lifting the flange 142*a* against the annular plate 146, for the working solution to run down through the annular plate 146, the orifice 132 and the opening 146 toward the developing tank 70.

When the solenoid 114 is de-energized, the tilting plate 120 is brought back to its original horizontal position by the spring means 124 replacing the solution supplying tank 72 in its original horizontal position, thereby detaching the valve head 142*b* from the step 148 and replacing the flange 142*a* on the annular plate 146 for closing the valve unit 140.

The energizing and de-energizing signal for the solenoid 114 is controlled by the circuit means C, arranged in the electrophotographic copying apparatus of the invention.

Figure 3:
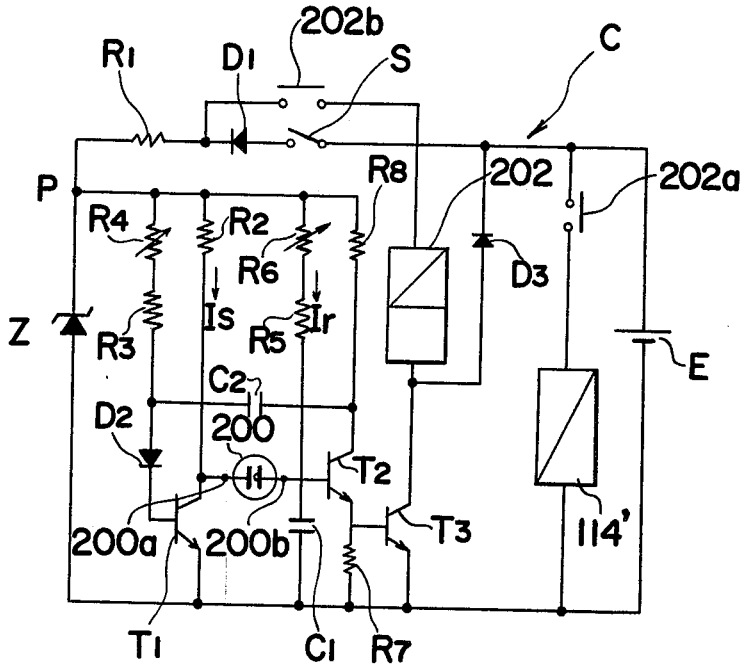
FIG. 3 is an electrical circuit diagram illustrating a circuit for integrating the length of the copy paper fed through the copying apparatus of FIG. 1.

Referring to FIG. 3, showing a diagram of the circuit means C, the switch S indicates the above mentioned switch *sw* which corresponds to the detecting means B. The contactor arm of the switch S is connected with a terminal of the power source E, while the stationary contact of the switch S is connected with an anode of zener diode Z through a diode D1 and a resistor R1. The numeral 200 designates an integrator namely an E-CELL which is a trade name of a product by PLESSELY ELECTRO PRODUCT CO. LTD. U.S.A., wherein a ionized Ag is carried from one electrode to the other electrode so as to accumulate Ag in said other electrode, in relation to the current flow therethrough. When the current flows from the case electrode 200*a* toward the central electrode 200*b*, the voltage drop between the case electrode 200*a* and the central electrode 200*b* is relatively low to about several mV. during which the E-CELL is in set state.

After having set the E-CELL, the current may flow in the opposite direction, i.e., from the central electrode 200*b* to the case electrode 200*a*, to reset the E-CELL. During the reset performance, the resistance of the E-CELL is comparataively low, i.e., during a period when the accumulated Ag exists in the central electrode 200. However, the resistance thereof will become extremely high after all the accumulated Ag is carried back to the case electrode 200*a*.

Figure 5:
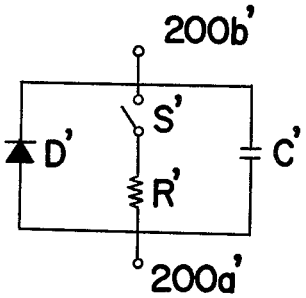
FIG. 5 is an electrical circuit diagram illustrating an equivalent circuit for electrical element applied to the circuit of FIG. 3.

Referring to FIG. 5, there is shown a diagram of the equivalent circuit for the E-CELL, wherein the terminals designated by numerals 200*a'* and 200*b'* are in equal relation to the case electrode 200*a* and the central electrode 200*b*. Between the terminals 200*a'* and 200*b'*, a diode D' and a capacitor C' are connected in parallel and also a series connection of resistor R' and a switch S' is connected therebetween. The switch S' is normally closed to flow a set current from terminal 200*a'* to terminal 200*b'* and then to flow a reset current from terminal 200*b'* to terminal 200*a'*. The switch S' opens after a certain period of time which is in relation to the disposal of accumulated Ag being carried back to the case electrode, and then the capacitor C' is charged up to a zener voltage to allow a current to flow in reverse direction through the diode D'.

Referring back to FIG. 3, the case electrode 200*a* of the E-CELL 200 is connected to the collector of a transistor T1 being grounded through the emitter thereof, and also to a common junction P being positioned between the resistor R1 and the zener diode Z through a resistor R2. The base of the transistor T1 is connected to the cathode of the diode D2 while the anode of the diode D2 is connected to the junction P through a resistor R3 and a variable resistor R4.

The central electrode 200*b* of the E-CELL 200 is connected to the base of a transistor T2 and a capacitor C1, and also to the junction P through a resistor R5 and a variable resistor R6. The emitter of the transistor T2 is connected to the base of a transistor T3, whose emitter is connected to the minus terminal of the power source E and whose base is connected to earth through a resistor R7.

The collector of the transistor T2 is connected to the junction P through a resistor R8 and also to the anode of the diode D2 through a capacitor C2.

The numeral 202 designates a relay element connected in between the power source E and the collector of the transistor T3, and a diode D3 is connected in parallel to the relay element 202. The numeral 114' indicates the solenoid 114, which is shown in FIG. 3, connected to the power source E through a relay switch 202*a*. Another relay switch 202*b* is connected in parallel to the series connection of the switch S and the diode D1.

In such circuit connection described above, the E-CELL 200 is set by a current Is flowing through resistor R2, which current Is is mainly determined by the magnitude of resistance in resistor R2, while a period Ts for the current Is to flow through the E-CELL 200 is set up by the magnitude of the resistance sum of the variable resistor R4 and the resistor R3 and also by the capacitance of the capacitor C2, and determined by the time during which the solenoid 114 is energized.

On the other hand, the E-CELL 200 is reset by a current Ir flowing through the resistor R5, and the amount of the current Ir is determined by the magnitude of the resistance sum of the variable resistor R6 and the resistor R5. The minimum period Tr for the current I*r* to flow through the E-CELL 200 is determined by the resistance magnitude of the resistor R5, which period T*r* is substantially equal to a non-operating period of the solution supply tank 72. The operating period of the solution supply tank 72 is preadjusted by the variable resistor R6 in accordance with the contrast between the bright and dark portions of the original to be copied and also with the width of the copy paper.

When the main power switch (not shown) is turned on, a predetermined voltage is applied to the junction P by a suitable circuit means (not shown) for flowing current Is toward the E-CELL 200 to bring the E-CELL 200 in set condition.

After the E-CELL 200 is set, the electrophotographic graphic copying apparatus is ready for copying operation. When the leading edge of the copy sheet turns on the switch S in the manner described above, a voltage is applied on the base of the transistor T1 which conducts the collector and the emitter of the transistor T1. Since the voltage drop between the central electrode 200*b* and the case electrode 200*a* is low during the set condition of the E-CELL 200, the transistor T2 is in non-conductive condition while the transistor T1 is in conductive condition. Therefore, the reset current I*r* flows through the variable resistor R6, resistor R5 and through the E-CELL 200, during which, the capacitor C2 is charged by the current flowing through the resistor R8 and diode D2.

When one sheet of the copy paper passes through the detecting projection 60*b*, the detecting arm 60 is replaced in its normal position to turn off the switch sw, till next leading edge of the copy paper arrives to depress the arm 60. In the meantime, the circuit means C is in off state to cut-off the reset current I*r*, and the reset of the E-CELL 200 is paused till the circuit is on again.

As in the same manner described above, the circuit means C resets the E-CELL 200 contained therein with respect to the copy paper passing along the arm 60.

According to the above described operation of the E-CELL 200, the E-CELL 200 integrates the reset current I*r* flowing therethrough, in other words, integrates the time during the passing period of the copy paper along the switch sw, namely, the length of the copy paper used in the apparatus. When the predetermined length of the copy paper is used in the apparatus, a certain amount of the toner is consumed in the developing tank 70, to be ready for being supplied.

When the reset current I*r* resets the E-CELL 200 to a minimum state, i.e., the minimum amount of Ag remaining in the central electrode 200*b*, the voltage between the case electrode 200*a* and the central electrode 200*b* becomes so high that the voltage applied on the base of the transistor T2 will conduct the collector and the emitter of the transistor T2. Therefore, the reset current I*r*, which was flowing toward the capacitor C2, now flows toward the collector of the transistor T2, causing the capacitor C2 to be discharged by the current coming from the resistor R3 with a predetermined time constant. Consequently, the transistor T1 is brought to non-conductive state, whereby the current directed to the collector of the transistor T1 is now directed to the case electrode 200*a* of the E-CELL 200 again.

While the transistor T2 being in the conductive state, the transistor T3 is also brought to a conductive state to actuate the relay element 202, so as to turn on the relay switches 202*a* and 202*b* to energize the solenoid 114 to perform the supply operation in the developing device D.

The discharge of the capacitor C2 will direct the current again toward the base of the transistor T1 to bring the collector and the emitter thereof conducted, and causing the transistor T2 in non-conductive state, and also the transistor T3 in con-conductive state.

It should be noted that the relay switch 202*b* is provided for actuating the circuit means C regardless of the on and off position of the switch S.

Consequently, the relay element 202 disengages the switches 202*a* and 202*b* to de-energize the solenoid 114 and to stop the supplying operation of the concentrated working solution into the developing tank 70.

Figure 4:
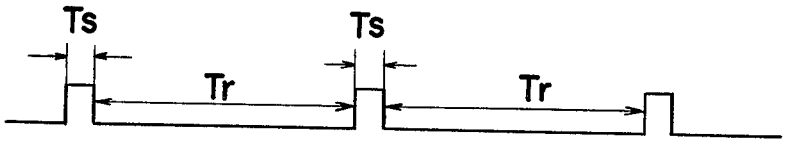
FIG. 4 is a timing chart showing the sequence of operation of supplying the developing material to the developing station which is controlled by the circuit shown in FIG. 3.

The developing tank 70 is supplied with the toner during the period of T*s*, as shown in FIG. 4, which is every time after the period of T*r* and in relation to the length of the copy paper used in the apparatus. The length of the period T*s* can be controlled by a change in the variable resistors R4 and R6, which will correspond to the various sizes of the copy papers prepared for the copying apparatus. The length of the period T*s* can be controlled by changes of the variable resistors R4 and R6.

Since the detecting means D together with the switch sw employed in the above described embodiment is only needed to detect the duration of the feeding period of the copy paper, the detecting means can be replaced by several other detecting means. For example, a switch (not shown) for the suitable driving means (not shown) which correspondingly drives the take-up rolls 52 with the period when the paper taken out from the roll 50 as described above may be associated with a switch for turning on and off the circuit means C. Another detecting means, comprising photodiode may be employed in a preferable position along the path K of the copy paper after the cutter 54, arranged in such a manner that the photodiode may receive a light from a suitable light source provided in the other side of the path K and the light directed to the photodiode may be intercepted by the copy paper coming along the path K, whereby generating a signal indicating whether the copy paper is being fed or not. Further detecting means, such as switch, may be associated with a switch for displacing the horizontally movable platform 30 described above, which switch will also indicate whether the copy paper is being fed or not.

By either of these arrangements, the circuit means C can be actuated in the same manner as in the switch sw employed in the first embodiment to integrate the length of the copy paper fed toward the developing tank 70.

Needless to say, the developing device D together with the detecting means B and the circuit means C described as employed in the above copying apparatus of wet developing type, can be readily incorporated in the copying apparatus of dry developing type.

It should be noted that the variable resistor R6 described as employed in the circuit means C of FIG. 3 can be replaced, for example, by a suitable rotary switch provided with a plurality of resistors to select a suitable amount of resistance with respect to the width of the copy paper or the contrast of the original to be copied, and that the E-CELL 200 described as employed in the circuit means C of FIG. 3 can be replaced by a suitable electrical element, so long as the element performs the same effect as E-CELL 200 described in the equivalent circuit of FIG. 5.

It should also be noted that, although the present invention is mainly described in the foregoing embodiment with reference to the electrophotographic copying apparatus of the type wherein the latent image transferred onto the copy material is directly developed, the copying apparatus of the present invention is not limited to the above described type, but may be of a type wherein latent image formed on the photoreceptor is developed into a visible toner image for subsequent transfer onto copy material, that is to say, the toner dispensing device directly relevant to the invention is readily applicable to the latter type of the copying apparatus.

As is clear from the foregoing description, the copying apparatus of the present invention provides an optimum condition of the image on the copy paper without any disturbance in the contrast of the image, and prevents a lack of developing material in the tank 70, by such a manner that the developing material consumed in the developing tank 70 is periodically supplemented accurately by detecting the length of the copy paper fed through the developing tank 70. The period for providing the developing material can be easily adjusted by changing the variable resistor R6.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A toner dispensing means for use in an electrophotographic copying apparatus having an optical system, means for forming an electrostatic latent image upon receipt of light rays projected through said optical system from an original to be copied, said electrostatic latent image corresponding to an image of the original which has been carried by said optical system, means for feeding copy material into contact with said latent image forming means, said toner dispensing means comprising:

toner storing means;

detecting means for detecting the length of copy material passing through the path means;

circuit means for electrically integrating the length of the copy material detected by said detecting means and for memorizing the integrated length of the copy material until the amount of the integrated length has reached a predetermined level and for generating the electrical output in the form of electrical pulses when the amount of the integrated length has reached a predetermined level, the said circuit means including an integrating circuit element which accumulates energy in the forward current and discharges the accumulated energy in the reverse current, whereby the internal resistance of the integrating circuit means is lower in the period when the accumulated energy is existing in said integrating circuit means than in the period when the accumulated energy is not existing therein; and supply means for supplying an amount of toner corresponding to said output signal from said integrating circuit means to the developing means.

2. A toner dispensing means as claimed in claim 1, wherein said integrating circuit element is an electrically integrating element wherein ionized Ag is carried from one electrode to the other electrode so as to accumulate Ag on said other electrode, in relation to the current flowing therethrough.

3. A toner dispensing means for use in an electrophotographic copying apparatus having an optical system, means for forming an electrostatic latent image upon receipt of light rays projected through said optical system from an original to be copied, said electrostatic latent image corresponding to an image of the original which has been carried by said optical system, means for developing said latent image into a visible image, path means for feeding copy material into contact with said latent image forming means, said toner dispensing means comprising:

toner storing means;

detecting means for detecting the length of copy material passing through said path means;

circuit means for electrically integrating the length of the copy material detected by said detecting means and for memorizing the integrated length of the copy material until the amount of the integrated length has reached a predetermined level and for generating the electrical output in the form of electrical pulses when the amount of the integrated length has reached a predetermined level, said integrating circuit means including output adjusting means for adjusting the period of signal produced therefrom; and supply means for supplying an amount of toner corresponding to said output signal from said integrating circuit means to the developing means.

4. A toner dispensing means as claimed in claim 3 wherein said detecting means is disposed in a predetermined position on one side of the path means and emitting a light therefrom and a photodiode means provided on the other side of the path means for receiving the light from the light source and generating a signal indicative of the period when the copying material passes between the light source and the photodiode means.

5. A toner dispensing means for use in an electrophotographic copying apparatus which comprises:

detecting means for detecting length of copy material;

integrating circuit means for electrically integrating the length of the copy material detected by said detecting means and for generating electrical output proportional to the integrated length in said integrated circuit means, said integrating circuit means including therein adjusting means for adjusting said electrical output; and supply means for supplying, from toner storing means to a developing station, an amount of toner corresponding to said electrical output from said integrating circuit means through said adjusting means.

6. A toner dispensing means as claimed in claim 5 wherein said adjusting means includes a switching means disposed in a path of the copy material and controlled for its actuation by passing of the copy material.

7. A toner dispensing means as claimed in claim 5 wherein said detecting means includes a switching means controlled for its actuation in synchronization with functioning of clutch means which selectively causes copy material feeding means to move and stop.

8. A toner dispensing means as claimed in claim 5 wherein said toner storing means includes valve means, and said toner supply means includes a solenoid actuated by said electrical output from said integrating circuit means for causing said valve means to open.

9. A toner dispensing means for use in an electrophotographic copying apparatus which comprises:

detecting means for detecting length of copy material;

integrating circuit means for electrically integrating the length of the copy material detected by said detecting means and for generating electrical output when the integrated length has reached a predetermined level, said integrating circuit means including therein an integrating element which accumulates energy in the forward current and discharges the accumulated energy in the reverse current, whereby the internal resistance of the integrating element in the reverse current is lower in a period when the accumulated energy is existing in said integrating element than in a period when the accumulated energy is not existing therein and said predetermined level of integrated length of said copy material is determined by an amount of said accumulated energy in the integrated element; and supply means for supplying, from a toner storing means to a developing station, an amount of toner corresponding to said electrical output from said integrating circuit means.

10. A toner dispensing means as claimed in claim 9 wherein said integrating element in said integrating circuit means is an electrically integrating element wherein ionized Ag is carried from one electrode to the other electrode so as to accumulate Ag on said other electrode, in relation to the current flowing therethrough.

11. A toner dispensing means as claimed in claim 9, wherein said detecting means is a micro switch disposed in the path means so as to be actuated by the passing of the copy material through the path means.

12. A toner dispensing means as claimed in claim 9, wherein said toner storing member includes valve means and said supply means is a solenoid which is actuated by the output signal from said integrating circuit means for causing valve said means to open.

* * * * *